US006686896B2

(12) United States Patent
Oishi et al.

(10) Patent No.: US 6,686,896 B2
(45) Date of Patent: Feb. 3, 2004

(54) PLASMA DISPLAY PANEL

(75) Inventors: Toshiharu Oishi, Shizuoka-ken (JP); Akihiko Horita, Shizuoka-ken (JP); Hiroshi Tsuboi, Shizuoka-ken (JP)

(73) Assignee: Pioneer Corporation, Tokyo (JP)

( * ) Notice: Subject to any disclaimer, the term of this patent is extended or adjusted under 35 U.S.C. 154(b) by 2 days.

(21) Appl. No.: 10/101,266

(22) Filed: Mar. 20, 2002

(65) Prior Publication Data

US 2002/0145386 A1 Oct. 10, 2002

(30) Foreign Application Priority Data

Apr. 10, 2001 (JP) ..... 2001-111228

(51) Int. Cl.[7] ..... G09G 3/28
(52) U.S. Cl. ..... 345/60; 313/485; 315/169.4
(58) Field of Search ..... 315/169.3, 169.4; 313/485, 486, 586; 345/60, 63, 65, 66, 72

(56) References Cited

U.S. PATENT DOCUMENTS 5,396,149 A * 3/1995 Kwon ..... 345/65
5,892,492 A * 4/1999 Osawa et al. ..... 345/60

* cited by examiner

*Primary Examiner*—Wilson Lee
(74) *Attorney, Agent, or Firm*—Arent Fox Kintner Plotkin & Kahn, PLLC

(57) ABSTRACT

A plasma display panel for color displaying is provided which is so formed that it is possible to improve the contrast and color purity of the display panel while at the same time controlling the brightness drop to a minimum level. In particular, it is possible to effectively inhibit a contrast drop usually caused due to neon emission. In practice, an optical filter capable of attenuating light components each having a wavelength within a range of 560–590 nm is provided on the front side of the plasma display panel. Such plasma display panel includes an electric discharge space containing a discharge gas mainly comprising neon gas and xenon gas.

2 Claims, 2 Drawing Sheets

PLASMA DISPLAY PANEL

BACKGROUND OF THE INVENTION

1. Field of the Invention

The present invention relates to a plasma display panel capable of color displaying, particularly to a plasma display panel which can perform color displaying and allow an improved visibility.

The present application claims priority from Japanese Application No. 2001-111228, the disclosure of which is incorporated herein by reference for all purposes.

2. Description of the Related Prior Art

A plasma display panel comprises a pair of glass substrates facing each other and having an electric discharge space formed therebetween. The pair of glass substrates include a front glass substrate providing a display surface and a rear glass substrate positioned opposite to the front substrate. In fact, such a plasma display panel is an AC-type display panel, the front substrate of which has a plurality of row electrode pairs formed by transparent electrodes (for electric discharge) and provided on the inner surface of the front substrate. Actually, these row electrodes are covered by a transparent dielectric layer as well as a protection layer. On the other hand, the rear glass substrate has a plurality of column electrodes serving as data electrodes (for data writing) and provided on the inner surface thereof. Similarly, these column electrodes are covered by a protection layer.

The front glass substrate and the rear glass substrate are bonded together along their edge portions with a sealing layer interposed therebetween. In fact, between the front glass substrate and the rear glass substrate, there are provided a plurality of stripe-like partition walls forming a plurality of elongated discharge spaces along the column electrodes. In this way, the row electrodes are arranged to be orthogonal to the column electrodes. Further, each elongated discharge space is provided with a fluorescent layer for emitting a visible light or for producing a color effect and is filled with a discharge gas which is in fact a gas mixture mainly containing neon gas and xenon gas. In practice, the fluorescent layers include three original colors Red, Green and Blue which are arranged in a predetermined regular order, thereby effecting a desired color display.

In use, an electric discharge is selectively effected in accordance with display data, along each display line formed by a pair of row electrodes. In fact, such discharge is effected between one of the two electrodes forming the row electrode pair and a column electrode. Accordingly, lighting cells (having wall charges formed therein) and erasing cells (not having wall charges formed therein) are thus selectively formed, thereby forming a desired picture on the display. Then, a plurality of sustaining pulses are repeatedly supplied to the display lines, so as to maintain the light emission of the lighting cells by applying the sustaining pulses.

However, the above-described conventional plasma display panel has at least the following problems caused due to contrast drop which is in turn caused due to an external light reflection.

Namely, since fluorescent material used in the plasma display panel is formed by an inorganic fluorescent powder, there is a large reflection caused due to external light reflection. As a result, erasing cells serving as non-displaying portions will be recognized brightly due to the external light reflection, making it impossible for the non-displaying portions to produce sufficient black display.

Another problem associated with the above-described conventional plasma display panel is caused due to a visible light emitted by the neon gas contained in the discharge gas. Namely, when the discharge gas mainly contains the neon gas and xenon gas, an ultraviolet light emitted during an electric discharge can cause the excitation of the respective fluorescent layers, thereby emitting visible light rays having spectral characteristics corresponding to the respective fluorescent layers. At this time, the neon gas itself emits a light which is a visible light ray having a peak in a specific wavelength region. In fact, the neon emission will cause neon light component (having an emission peak in the vicinity of about 590 nm) to occur in the light emission spectrums of the respective color light rays, thus reducing the color purity of the respective color light rays and causing a low contrast for the plasma display panel.

In order to avoid the low contrast of a plasma display panel (which is caused due to external light reflection), an absorption type ND filter having a substantially uniform transmittance everywhere is provided on the displaying side of the plasma display panel. Alternatively, a color filter corresponding to the respective fluorescent layers of R,G,B colors is disposed at the same position in order to obtain the similar effect. However, in the case where ND type filter is used, although an external light reflection can be reduced and thus the contrast of the plasma display panel is improved, it is difficult to avoid a significant reduction in the brightness of the display panel (if it is desired to avoid undesired effects caused by the external light reflection as well as by the neon emission). On the other hand, in the case where the color filter is employed, production cost will be increased due to the use of a color filter capable of handling various colors.

SUMMARY OF THE INVENTION

An object of the present invention is to provide an improved plasma display panel capable of effectively inhibiting a contrast drop possibly caused due to neon light emission, thereby ensuring an improved contrast and an improved color purity while at the same time minimizing the brightness drop of the display.

In a first aspect of the present invention, there is provided a plasma display panel comprising: a pair of substrates arranged opposite to each other with an electric discharge space formed therebetween; an amount of electric discharge gas mainly containing neon and xenon, which is sealed within the electric discharge space; and a plurality of fluorescent layers disposed within the discharge space, which fluorescent layers are adapted to be excited by an ultraviolet ray emitted from the discharge gas, so as to emit light rays of red, green and blue colors.

In particular, an optical filter is provided on the front side of the display panel, said optical filter having such an transmission characteristic that the filter can selectively attenuate light components having a wavelength range extending from the wavelength region of a visible light emitted by neon gas to a longer wavelength region which is close to a wavelength at which an emission characteristic of each green-light emitting fluorescent layer exhibits its peak.

In a second aspect of the invention, the light components to be selectively attenuated by the optical filter have a wavelength of 560–590 nm.

In a third aspect of the invention, the optical filter is so formed that its transmittance for light components to be selectively attenuated is 70% or less of its transmittance corresponding to a wavelength at which the emission characteristic of red light emitting fluorescent layer exhibits its peak.

In a fourth aspect of the invention, the optical filter is so formed that its transmittance for light components to be selectively attenuated is 80% or less of its transmittance corresponding to a wavelength at which the emission characteristic of green light emitting fluorescent layer exhibits its peak.

In a fifth aspect of the invention, the optical filter is so formed that its transmittance for light components to be selectively attenuated is 70% or less of its transmittance corresponding to a wavelength at which the emission characteristic of blue light emitting fluorescent layer exhibits its peak.

According to the first aspect of the present invention, with the use of the optical filter provided on the front side of the plasma display panel, it becomes possible to selectively attenuate light components having a wavelength range extending from a wavelength region of a visible light emitted by neon gas to a longer wavelength region which is close to a wavelength at which an emission characteristic of each green-light emission fluorescent layer exhibits its peak. In this way, it is possible to attenuate a neon emission peak on a longer wavelength side when a blue light emitting fluorescent layer or a green light emitting fluorescent layer acts as a light emitting section, it is also possible to attenuate a neon emission peak on a shorter wavelength side when a red light emitting fluorescent layer acts as a light emitting section, thereby making it possible to clearly divide spectrum characteristics of various colors and thus improve color purity. In fact, light components (having a wavelength range extending from a wavelength region of a visible light emitted by neon gas to a longer wavelength region which is close to a wavelength at which an emission characteristic of each green-light emitting fluorescent layer exhibits its peak) contain peaks of spectral characteristics of while color fluorescent lamps commonly used in indoor illumination. Further, since these light components are in a wavelength region having a high specific visibility, the selective attenuation is effective for attenuating an external light reflection of the plasma display panel (caused due to indoor illumination), thereby effectively preventing the contrast drop possibly caused due to the external light reflection. Moreover, since it is possible to set a sufficiently high transmittance for other light components having other wavelengths than those described in the above, the use of the optical filter makes it possible to effectively minimize the brightness drop.

According to the second aspect of the invention, light components to be selectively attenuated by the optical filter has a wavelength of 560–590 nm. Namely, a neon emission peak occurring in the vicinity of 590 nm is attenuated, and it is possible for an attenuation effect to extend to a wavelength region in the vicinity of 530 nm which is a peak wavelength representing an emission characteristic of each green light emitting fluorescent layer. In this way, it is possible to inhibit an orange light emission produced by each red light emitting fluorescent layer, as well as to inhibit yellow/green light components emitted by each green light emitting fluorescent layer and blue light emitting fluorescent layer, thereby improving the color purity of the fluorescent layers of various colors R, G, B. Further, since the light components in the wavelength region of 560–590 nm are attenuated from external light reflection at non-light emitting sections, it is possible to effectively reduce the external light reflection caused due to indoor illumination containing light components having such a wavelength.

According to the third to fifth aspects of the invention, the optical filter is so formed that it exhibits a transmittance which is 70% or less of the transmittance of a red light, 80% or less of the transmittance of a green light, 70% or less of the transmittance of a blue light, thereby ensuring a sufficient transmittance for each light component and thus minimizing a brightness drop.

BRIEF DESCRIPTION OF THE DRAWINGS

These and other objects and advantages of the present invention will become clear from the following description with reference to the accompanying drawings, wherein.

DETAILED DESCRIPTION OF THE PREFERRED EMBODIMENT

Figure 1:
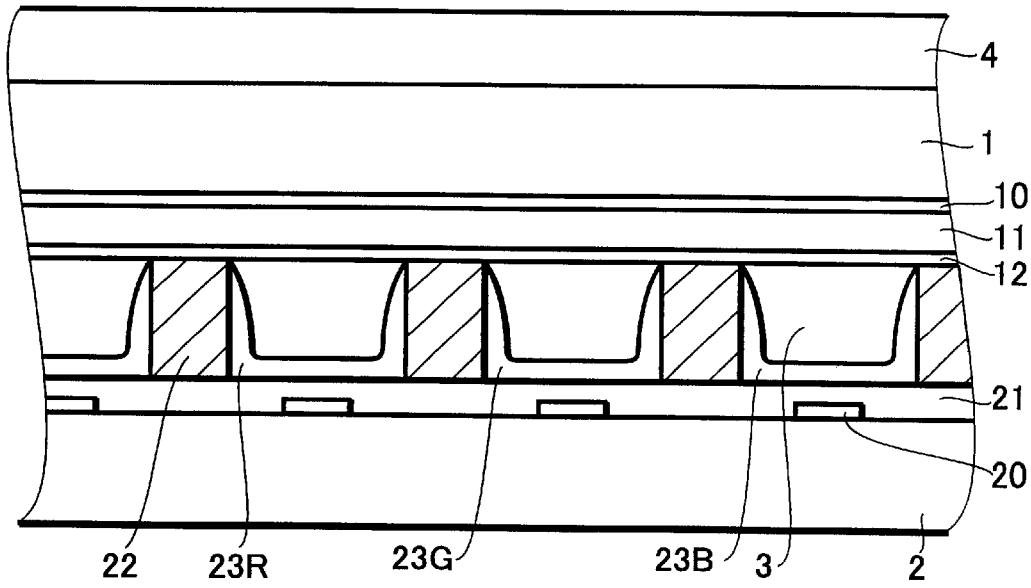
FIG. 1 is a cross sectional view showing a plasma display panel formed according to an embodiment of the present invention.

FIG. 1 is a cross sectional view showing a plasma display panel formed according to an embodiment of the present invention. In the drawing, reference numeral 1 is used to represent a front glass substrate and reference numeral 2 is used to represent a rear glass substrate. On the inner surface of the front glass substrate 1 there are formed a plurality of row electrodes 10, a dielectric layer 11 covering the row electrodes 10, and a protection layer 12 for protecting the dielectric layer 11. On the inner surface of the rear glass substrate 2 disposed opposite to the front glass substrate 1, there are formed a plurality of column electrodes 20, and an electrode protection layer 21 covering the column electrodes 20. A plurality of stripe-like partition walls 22 are provided on the electrode protection layer 21, with each column electrode 20 interposed between adjacent two stripe-like partition walls 22. Fluorescent layers 23R for emitting red light, fluorescent layers 23G for emitting green light and fluorescent layers 23B for emitting blue light are disposed at a predetermined interval on the inner sides of respective discharge cells formed by the partition walls 22. The front glass substrate 1 and the rear glass substrate 2 are arranged to face each other, with an electric discharge space 3 formed therebetween. In fact, the discharge space 3 is divided by the partition walls 22 into a plurality of smaller spaces. In this way, a plurality of discharge cells are formed on the intersections of the row electrodes 10 with the column electrodes 20.

Here, the front glass substrate 1 and the rear glass substrate 2 are bonded together along their edge portions with a seal layer interposed between the edge portions and with the discharge space 3 formed between the two glass substrates. Then, a discharge gas mainly containing neon gas and xenon gas is sealed into the discharge space 3 for use within the display panel. In this way, during an electric discharge, an ultraviolet ray emitted from the neon gas will cause the excitation of the respective fluorescent layers 23R, 23G and 23B, rendering the fluorescent layers to emit visible light rays of various colors. The emitted light rays are then allowed to emit outwardly through the front glass substrate 1, thus enabling a human being to recognize these light rays.

Furthermore, an optical filter 4 is provided over the entire surface of the front glass substrate. Such an optical filter 4 is formed by a substrate material having a predetermined light transmittance and containing a pigment having a predetermined specific light absorbability.

Figure 2:
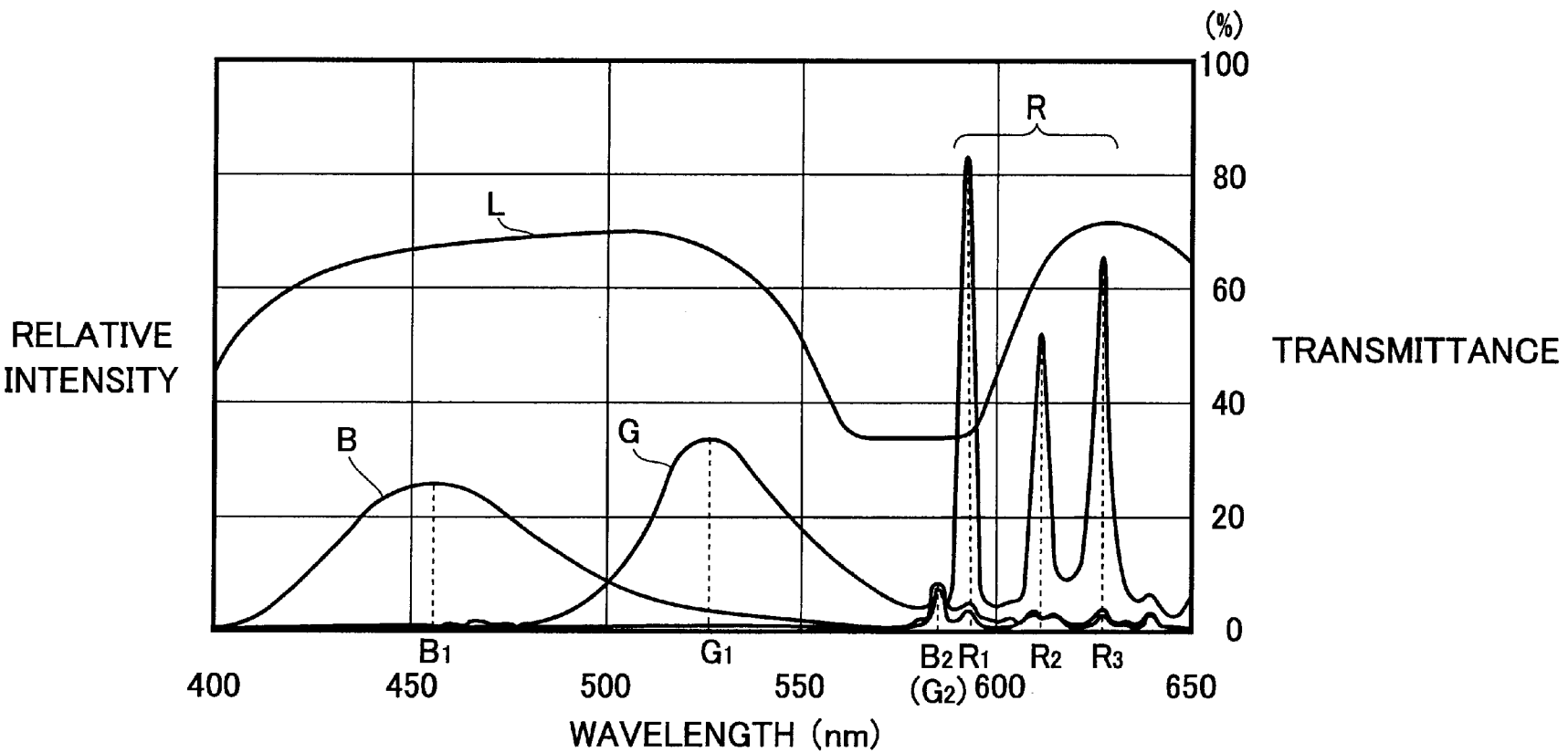
FIG. 2 is a graph showing optical characteristics of the plasma display panel formed according to the embodiment of the present invention, indicating the light emission characteristics (relative intensities) of the respective discharge cells as well as the light transmittance of an optical filter associated with the display panel.

FIG. 2 is a graph showing optical characteristics of the plasma display panel formed according to the embodiment of the present invention, indicating the light emission characteristics (relative intensities) of the respective discharge cells as well as the light transmittance of the optical filter associated with the display panel.

At first, description will be given to explain the light emission characteristics of the discharge cells of various colors. In the graph, curve B is used to represent a light emission spectrum for each blue color discharge cell. Namely, the fluorescent layer 23B excited by an ultraviolet ray produced during an electric discharge will emit a visible light having a peak at a wavelength B1 (about 460 nm). Meanwhile, neon emission occurs, producing a light component having a peak at a wavelength B2 (about 585 nm). Similarly, curve G is used to represent a light emission spectrum for each green discharge cell. Namely, the fluorescent layer 23G excited by an ultraviolet ray will emit a visible light having a peak at a wavelength G1 (about 530 nm). Meanwhile, neon emission occurs, producing a light component having a peak at a wavelength G2 (about 585 nm).

As for each red discharge cell, an emission spectrum shows three significant peaks at a wavelength R1 (about 590 nm), a wavelength R2 (about 615 nm) and a wavelength R3 (about 630 nm).

Next, description will be given to explain the optical filter 4 which has a spectral transmittance characteristic represented by a curve L in the graph. Namely, the spectral transmittance characteristic is attenuated in the vicinity of 590 nm which is a wavelength region of a visible light ray produced by neon emission. Further, the attenuation characteristic extends to a peak vicinity (560 nm) that is in the green discharge cell's emission spectrum which itself has a peak in the vicinity of 530 nm.

The optical filter 4 is so formed that its transmittance in its attenuation wavelength region 560–690 nm is at 70% or less of a transmittance in the vicinity of 630 nm in which there is a peak of the red emission spectrum, 80% or less of a transmittance in the vicinity of 530 nm in which there is a peak of the green emission spectrum, 70% or less of a transmittance in the vicinity of 460 nm in which there is a peak of the blue emission spectrum. In other words, if a transmittance in the attenuation wavelength region 560–690 nm of the optical filter 4 is set at 35%, a transmittance at 630 nm will be 50% or more, a transmittance at 530 nm will be 43.8% or more, a transmittance at 460 nm will be 50% or more.

In this way, when the optical filter 4 is provided on the front side of the plasma display panel, it is possible to improve the visibility during electric discharge of the discharge cells of various colors. Namely, with regard to the blue discharge cells, a neon light (having a wavelength in the vicinity of 585 nm) contained in its emission spectrum will be attenuated significantly once it passes through the optical filter. This is because the optical filter has a sufficient attenuation capability in a wavelength region of 560–590 nm. By selectively attenuating yellow/blue light component during blue light emission and by selectively attenuating neon component, it is allowed to display a blue color having a high color purity. On the other hand, with regard to visible light rays not having a wavelength 560–590 nm, the optical filter 4 exhibits a relatively high transmittance without any attenuation peak, thereby inhibiting the attenuation of a visible light ray (mainly containing blue light) having a peak at 430 nm. Therefore, with regard to the emission of the blue discharge cells, it is possible to improve the color purity and at the same time to prevent a brightness drop of the display panel.

With regard to the green discharge cells, it is also possible to make use of the transmittance characteristic of the optical filter 4. Namely, green/yellow component (having a high specific visibility) and neon component (having a wavelength in the vicinity of 585 nm) contained in the green emission spectrum will be attenuated significantly upon passing through the optical filter 4. At this time, since green light emission is easy to produce a desired brightness, it is possible for the main component of green light to produce a sufficient brightness by adjusting its output rays. In this way, by selectively attenuating the green/yellow light component and neon light component, it is possible to display a high purity green color.

With regard to each red color discharge cell, its emission spectrum has three large peaks. Namely, after passing through the optical filter 4, only a peak component (close to neon light component) having an orange color and having a wavelength in the vicinity of 590 nm is attenuated. On the other hand, other two peak components are attenuated by a smaller amount. In this way, by selectively attenuating the orange light component and the neon light component, it is sure to improve the color purity of the red light emission.

Further, with regard to the respective discharge cells, using the transmittance characteristic of the optical filter 4, it is possible to commonly attenuate the light components having a high specific visibility (with respect to an external light reflection), thereby effectively reducing an undesired effect caused by the external light reflection.

In this way, the optical filter 4 can be used to attenuate not only neon light components of various colors, but also light components having a high specific visibility (which light components have a wavelength longer than a wavelength at which the emission characteristic of a green fluorescent layer shows its peak), thereby allowing other light components to pass through the optical filter with a higher transmittance. In this way, it is possible to improve the color purity and reduce an undesired light reflection, thereby improving the contrast and at same time minimizing a brightness reduction of the display panel.

As to an external light reflection on the plasma display panel used under an indoor condition, although the visibility of a display panel depends greatly on the spectrum characteristic of an indoor light source, since the optical filter of the invention can be used to effectively attenuate a main component (having a wavelength of 570–580 nm) of a light emitted from a white color fluorescent lamp (most commonly used in an indoor condition), it is possible to exactly inhibit the undesired effect caused due to the external light reflection.

Although the present embodiment has shown that the optical filter 4 is tightly attached to the front glass substrate, it is also possible that such an optical filter can be disposed in a position close to the front glass substrate with an appropriate clearance formed therebetween, thereby obtaining the same optical effect.

As described in the above, the plasma display panel for color displaying is characterized in that an optical filter is provided on the front displaying side of the display panel, which optical filter has such an optical transmittance that it can selectively attenuate light components having a wavelength range extending from neon emission wavelength region to a longer wavelength region close to a wavelength at which green light has its emission peak. Therefore, it is possible to improve the contrast and color purity of the display panel while at the same time to control the brightness drop to a minimum level. In particular, it has become possible to effectively inhibit a contrast drop usually caused due to an external light reflection as well as due to neon emission, thereby making it sure to improve the visibility of the plasma display panel.

While the invention has been described in conjunction with preferred specific embodiment thereof, it will be understood that this description is intended to illustrate and not limit the scope of the invention, which is defined by the following claims.

What is claimed is:

1. A plasma display panel comprising:

a pair of substrates arranged opposite to each other with an electric discharge space formed therebetween;

an amount of electric discharge gas mainly containing neon and xenon, which is sealed within the electric discharge space; and a plurality of fluorescent layers disposed within the discharge space, which fluorescent layers are adapted to be excited by an ultraviolet ray emitted from the discharge gas, so as to emit light rays of red, green and blue colors, wherein a single optical filter is provided on the front side of the display panel, said optical filter having a transmission characteristic such that the single filter can selectively attenuate light components having a wavelength range extending from the wavelength region of a visible light emitted by neon gas to a longer wavelength region which is close to a wavelength at which an emission characteristic of a green-light emitting fluorescent layer exhibits a peak;

wherein the light components to be selectively attenuated by the optical filter have a wavelength of 560–590 nm;

wherein the optical filter is so formed that a transmittance for said light components to be selectively attenuated is 70% or less of a transmittance corresponding to a wavelength at which the emission characteristic of red light emitting fluorescent layer exhibits a peak;

wherein the optical filter is so formed that a transmittance for said light components to be selectively attenuated is 80% or less of a transmittance corresponding to a wavelength at which the emission characteristic of said green light emitting fluorescent layer exhibits said peak.

2. The plasma display panel according to claim 1, wherein the optical filter is so formed that a transmittance for light components to be selectively attenuated is 70% or less of a transmittance corresponding to a wavelength at which the emission characteristic of a blue light emitting fluorescent layer exhibits a peak.

* * * * *

UNITED STATES PATENT AND TRADEMARK OFFICE

CERTIFICATE OF CORRECTION

PATENT NO. : 6,686,896 B2
DATED : December 2, 2003
INVENTOR(S) : Takayuki Ishikawa et al.

It is certified that error appears in the above-identified patent and that said Letters Patent is hereby corrected as shown below:

Title page,
Item [73], Assignee, please add -- Pioneer Display Products Corporation, Shizuoka-ken (JP) --.

Signed and Sealed this

Twenty-seventh Day of April, 2004

JON W. DUDAS
*Acting Director of the United States Patent and Trademark Office*